United States Patent [19]

Ericsson

[11] 3,942,460

[45] Mar. 9, 1976

[54] SHIP HULL AND A METHOD OF ASSEMBLING THE SAME

[75] Inventor: Lennart Ericsson, Goteborg, Sweden

[73] Assignee: Trans-Consultants Aktiebolag, Goteborg, Sweden

[22] Filed: June 3, 1974

[21] Appl. No.: 476,113

[30] Foreign Application Priority Data

June 5, 1973 Sweden ..... 7307902

[52] U.S. Cl. ..... 114/77 R

[51] Int. Cl.[2] ..... B63B 3/02

[58] Field of Search..... 114/.5 R, .5 D, 43.5, 56, 114/61, 65 R, 66.5 F, 72, 73, 74 A, 77 R, 77 A, 125, 123, 16 R

[56] References Cited

UNITED STATES PATENTS

| | | | |
|---|---|---|---|
| 1,303,690 | 5/1919 | Leparmentier | 114/61 |
| 1,510,283 | 9/1924 | Lake | 14/16 R |
| 3,822,661 | 7/1974 | Simpson | 114/61 |

*Primary Examiner*—Trygve M. Blix
*Assistant Examiner*—Jesus D. Sotelo
*Attorney, Agent, or Firm*—Pollock, Vande Sande & Priddy

[57] ABSTRACT

In most ships or other marine vessels the hull has a double bottom, hull sides and at least one deck. The hull of the invention has at least two fore-and-aft arranged hollow cylinders with considerable buoyancy and constituting an integral part of the double bottom. All plating of the hull is plane, single bent or cylinder casing-shaped. The assembly of the hull is carried out on the surface of a protected water area and is commenced by floating the assembled hollow cylinders on the water surface in parallel relation to each other. The cylinders are then used as a base for assembling prefabricated building sections which are connected successively to the cylinders and/or to each other until the hull is completed.

12 Claims, 10 Drawing Figures

SHIP HULL AND A METHOD OF ASSEMBLING THE SAME

The present invention relates to a novel hull for ships or other marine vessels and a novel method of assembling such hulls. The novel hull has a double bottom construction comprising an outer bottom, transitional parts between the outer bottom and the sides of the hull and an inner bottom which is extended between the sides of the hull above the outer bottom. In the method of assembly of the hull according to the present invention, to a necessary degree pre-fabricated base members are joined together so as to form building sections which, along with equipment parts, are then transported to and stored at a storage location located near an assembly location intended for the hull and formed by a protected water area. The sections are then moved, in planned sequence, from the storage location to the assembly location in order to there be joined together in intended mutual positions.

Demands for increased economy of operation have led to a rapid increase in the size of ships. This has led to a corresponding increase not only in the initial investment which is required, but also in overhead for those shipyards which have the capacity for assembling such large vessels.

The object of the present invention is thus primarily to obtain a hull which, because of of its construction, does not require access to a shipyard for its assembly and which has simplified basic components as compared to conventional ships so that assembly costs will be lowered. Another principal object of the invention is to obtain a method of assembling the hull according to the present invention without requiring access to the resources of a conventional shipyard.

BRIEF DESCRIPTION OF THE DRAWINGS

As instructive examples, an embodiment of the hull according to the present invention and an example of the method according to the present invention of assembling said hull are described below with reference to the enclosed drawings, wherein.

Figure 1:
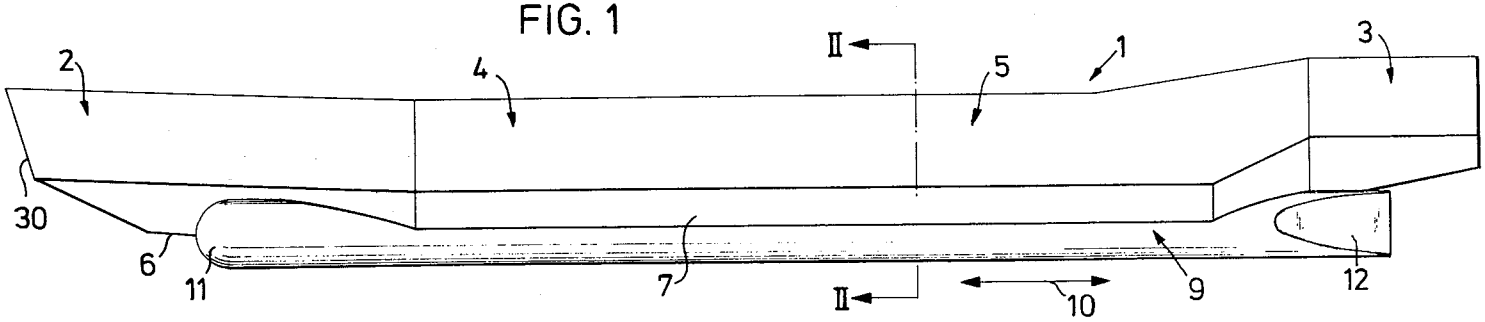
FIG. 1 is a side view of an embodiment of the hull.

The embodiment of the completed hull 1 shown in a side-view in FIG. 1 has a bow section 2 and a stern section 3 as well as a mid section 4 extending between the bow and the stern sections. The shell plating of the middle body has been referred to as 5 while the transitional parts between the shell plating 5 and the outer bottom 6 of the hull are referred to as 7. The closest-situated of the cylinders 9, which cylinders function as bedding during assembly and thereafter as an integrated part of the double bottom construction 8, is also shown in FIG. 1. The cylinders 9, which run along the fore-and-aft direction 10 of the hull 1 are terminated at their ends by specially formed end sections or end pieces 11 and 12.

Figure 2:
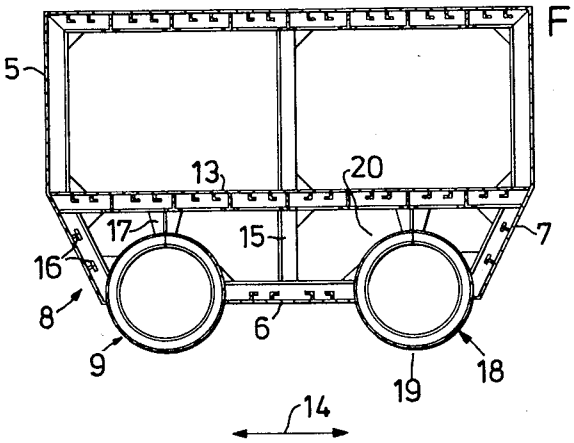
FIG. 2 is a cross section along line II—II through the hull shown in FIG. 1.

FIG. 2 shows that the double bottom 8 comprises an outer bottom 6, transitional parts 7 between the outer bottom and the shell plating 5, cylinders 9 and an inner bottom 13. Double bottom 8 also has reinforcements fore-and-aft (10) and/or athwartships (14) such as for example 15 and 16, as well as different attachment means, for example 17, required for the fastening of the cylinders 9.

The embodiment shown in FIG. 2 has two cylinders 9 which are spaced in the athwartships direction 14, said cylinders, in the fore-and-aft direction 10, having essentially the same length as the mid section 4 of the hull. However, three or more cylinders 9 spaced athwartships are also within the scope of the invention. While the cylinders may be of different lengths, it is essential that they be hollow, thereby contributing to a great extent to the buoyancy of the hull. FIG. 2 also shows that the casings 18 of the cylinders 9 have portions 19 mounted on the outside of the double bottom construction 8 and other portions 20 mounted inside the double bottom 8. Such is the case at least along the major part of the length of the cylinders 9. In the embodiment shown, the casing portions 19 and 20 are of essentially the same size. However, embodiments in which the casing portion 19 is very small in comparison to the portion 20 and vice versa lie within the scope of the invention. This is effected by means of the cylinders 9 being accommodated more or less within the double bottom 8. Cylinders 9 can also, in their entirety, be positioned at the transitional parts 7 or form transitional members between the transitional parts 7 and the outer bottom 6.

Figure 3:
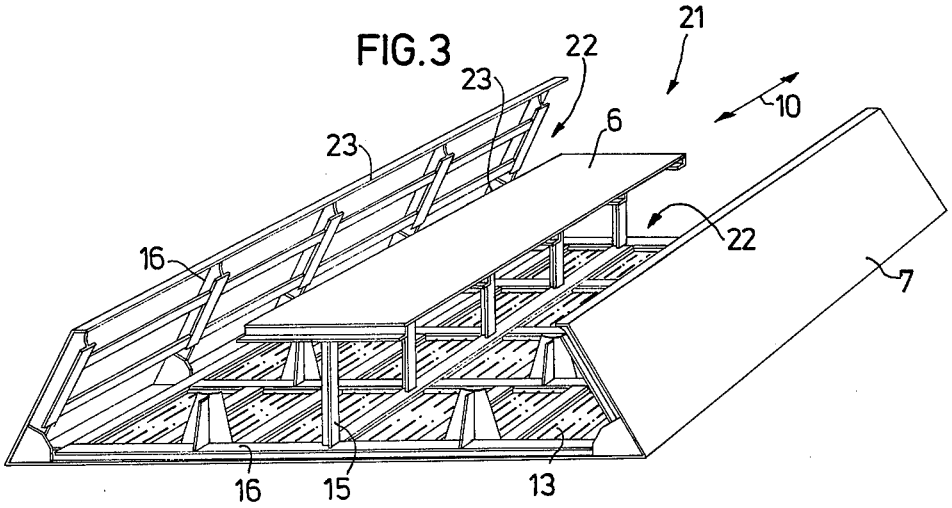
FIG. 3 is a perspective view of an upside down double bottom section of the hull shown in FIG. 1.

FIG. 3 is a perspective view of a building section 21 of the double bottom 8 of the hull 1 shown in FIGS. 1 and 2. In this figure, the bottom section 21 is upside down in relation to its intended position in the hull. The inner bottom 13 is thereby turned downwards and the outer bottom 6 is turned upwards. The inclined transitional parts 7 are visible on either side and, furthermore, various support and stiffening means 15, 16 are located on either side as well. Two openings 22 are arranged between the outer bottom 6 and the transitional parts 7, each of said openings being intended to contain its respective cylinder 9, the fore-and-aft extending edges 23 of the openings 22 being watertight and rigidly connected to the shells 18 of the cylinders 9. Similarly, at least the shell sections 19 which are situated outside of the edges 23 of the openings 22 are watertight, whereby the cylinders form an integrated part of the double bottom construction 8 of the hull 1.

Figure 4:
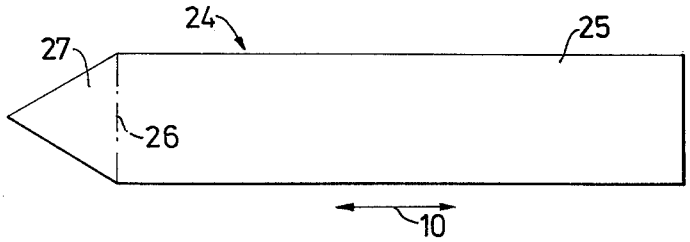
FIGS. 4 and 5 are examples of the water surface area above the cylinders integrated in the completed double bottom of the hull.
Figure 5:
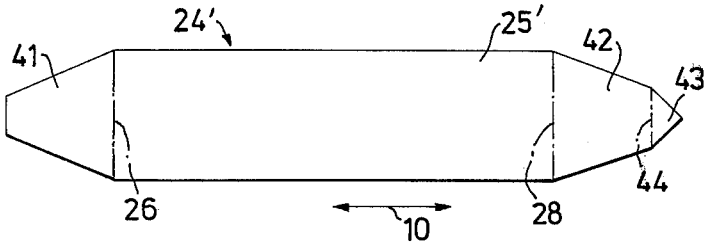

FIGS. 4 and 5 illustrate the shape of a hull according to the invention by showing the water line areas 24, 24' for two different embodiments of the hull 1. In both cases, the water line areas are situated above the cylinders 9, as otherwise the latter could cause great irregularities in the contours of the areas. The areas 24, 24' are defined by a plurality of straight lines (shown as solid lines in FIGS. 4 and 5). Areas 24, 24' are then divided into simple geometrical surface elements (shown by dotted lines), dominated in both figures by one large rectangular surface element 25, 25'. In FIG. 4, surface element 25 covers the mid-section 4 of the hull as well as its stern section 3, while surface element 25' in FIG. 5 covers only the mid section. FIG. 4 only shows a smaller triangular surface element 27 which is connected to one of the short sides 26 of the rectangle 25 and which forms a tapering extension to rectangle 25 in the fore-and-aft direction 10 of the hull 1. Surface element 27 covers the bow section 2 of the hull.

FIG. 5 has three smaller surface elements shaped as a triangle 43 or trapezoid 41, 42. Surface elements 41, 42 are connected to their respective short sides 26, 28 of rectangle 25' while element 43 is connected to the side 44 of element 42 which faces away from rectangle 25'. Elements 41, 42 form a tapering extension of the rectangle while element 43 forms a tapering extension of trapezoid 42.

Bow and stern sections which have water lines having simple geometrical surface elements combined in another manner than the one shown here also lie within the scope of the present invention.

Due to the form of the hull 1 shown in FIGS. 1–5, all the plates included in the hull have an uncomplicated shape. The plates are either plane or single bent or are shaped as at least a part of a cylindrical casing. Single bent plates are included for example in transitional parts 7 in the embodiment of the hull shown in FIGS. 1–3. Cylinder casing-shaped plates are naturally included mainly in the cylinders 9, with the possible exception of the end pieces 11, 12 of the cylinders. The stem plates 30 of the hull can also be cylinder casing-shaped.

The transitional parts 7, corresponding to "the bilge" in conventional hulls, have preferably plane or single bent plates. At least partially cylinder casing-shaped plates are, however, also feasible. When plane or single bent plates are used, they suitably incline inwardly and downwardly from the shell plating 5.

In a preferred embodiment of the hull according to the present invention, the opposing shell platings 5 are parallel or almost parallel to one another.

Figure 6:
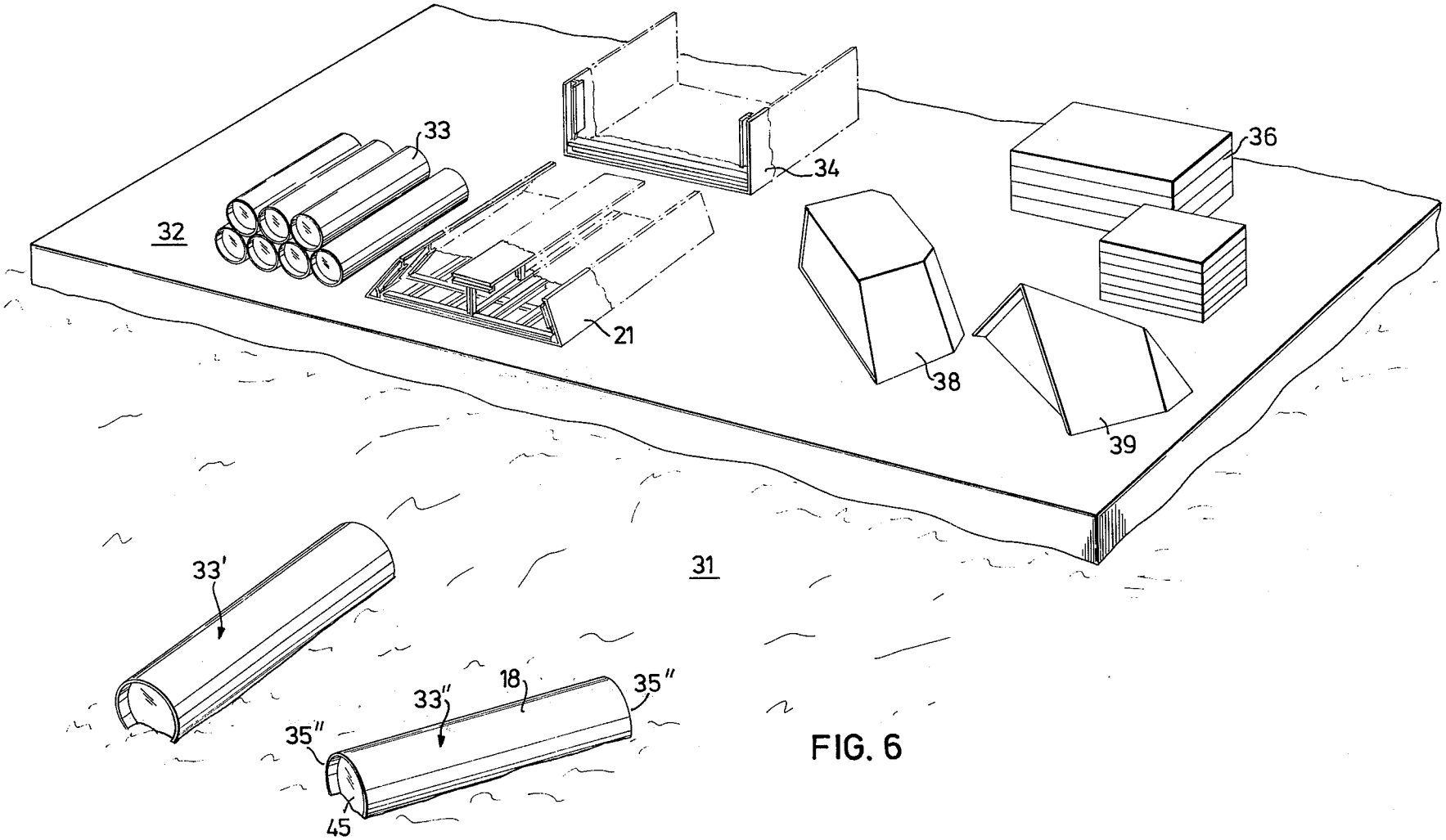
FIG. 6 is a view of two floating cylinder sections which have been transferred to the assembly location and the adjacent storage location.

An example of the method of assembly according to the present invention is illustrated in FIGS. 6–10. FIG. 6 shows a front view of the assembly station which is formed by a harbor basin or some other protected water area 31. A storage station is situated next to the assembly station, said storage station being in the form of, e.g., a quay 32, upon which prefabricated sections 21, 33, 34, 38, 39, equipment parts 36, etc., have previously been stored. As the hull is later assembled, the sections are brought from the storage station to the assembly station, for example by means of a lifting crane resting on the quay or being supported on pontoons. After delivery to the assembly station, the sections are joined together.

The cylinders included in the double bottom construction of the hull 1 are made of cylinder sections 11, 12, 33 in the manner shown in the drawings, said cylinder sections being prefabricated. In FIG. 6, two cylinder sections 33', 33'' are shown floating on the water. This is possible because each cylinder section, at this stage, has at least one watertight space contained between the cylinder casing 18 and end walls 34 arranged at a distance from the ends 35 of the cylinder sections.

Figure 7:
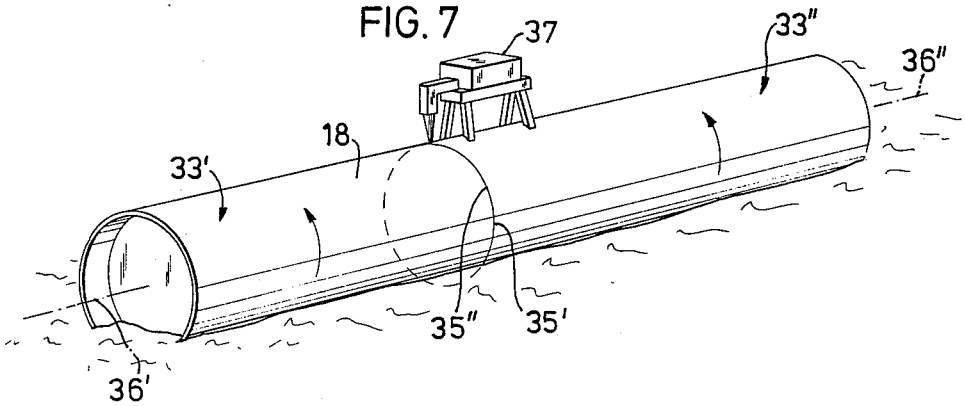
FIG. 7 illustrates the process for joining together two adjacent cylinder sections.

In FIG. 7, the two cylinder sections 33', 33'', still floating on the water, have been connected so that an extension of their respective longitudinal axes 36', 36'' coincides with the longitudinal axis of the other cylinder section, simultaneously as the facing ends 35', 35'' of the cylinder sections have been pulled in towards each other. As ends 35', 35'' have been prepared for welding, the ends can be welded to each other, after necessary tacking, said welding being effected either manually or by means of a suitable welding apparatus 37 while the cylinder sections are caused to rotate around their longitudinal axes, the peripheral speed of rotation of the cylinder section being synchronized to correspond to the welding speed.

By joining each cylinder section in a corresponding manner to the previously joined cylinder section, the completed cylinders 9 are produced, said cylinders having great buoyancy.

Figure 8:
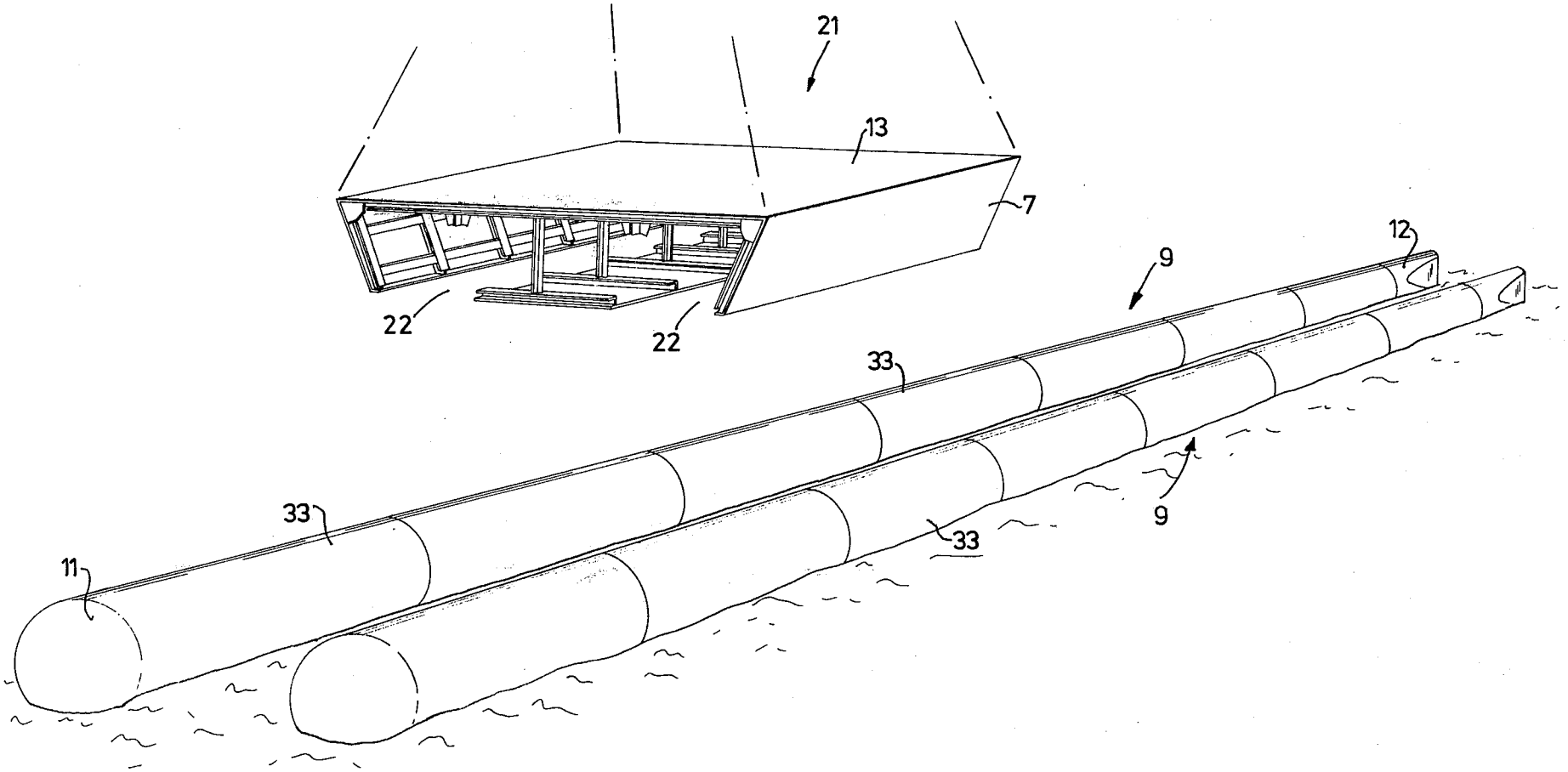
FIG. 8 shows the completed cylinders which serve as bedding and double bottom parts adjacent to each other for attachment of a first double bottom section.
Figure 9:
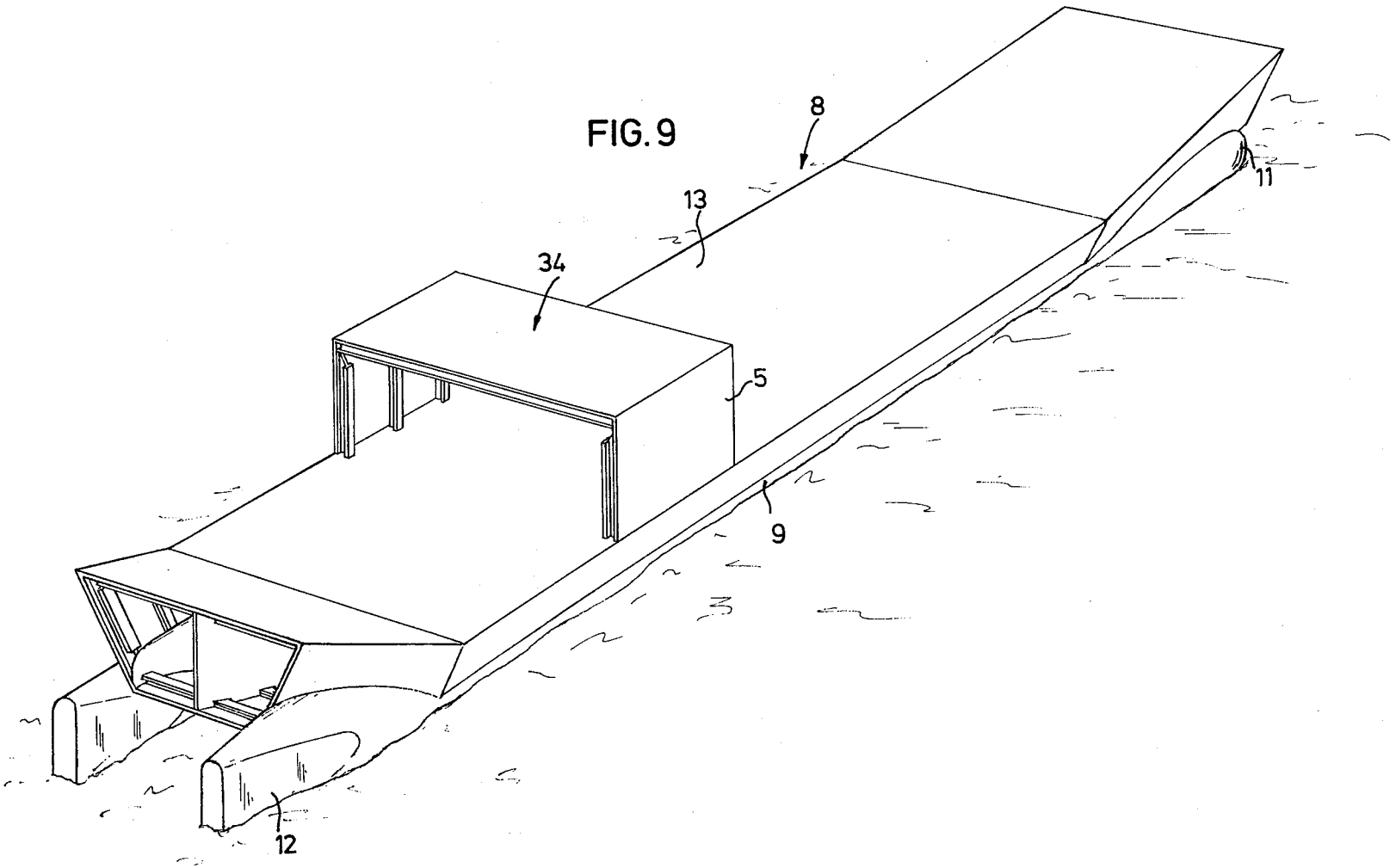
FIG. 9 shows the double bottom construction of the middle body after completion, with a first deck and shell plating section lowered onto the same.
Figure 10:
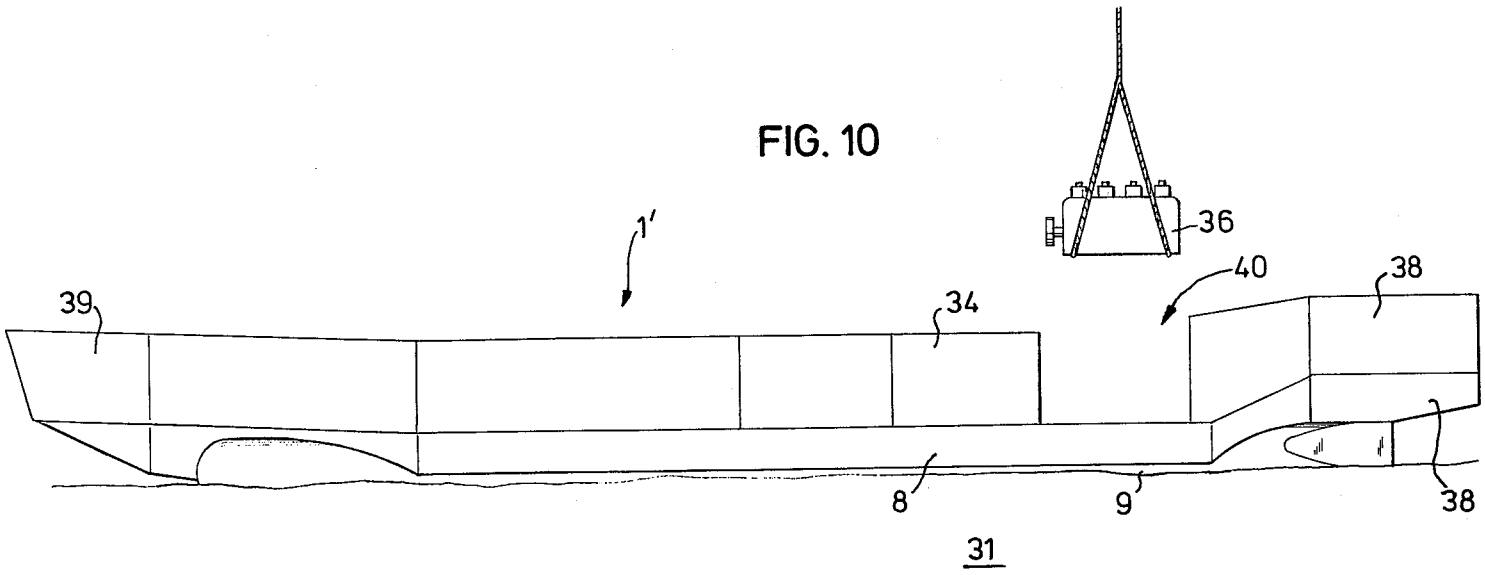
FIG. 10 shows the hull in a final stage during completion with bulky equipment purposefully before the previously excluded sections have been mounted into position.

In FIG. 8, the completed cylinders have been mounted parallel with one another at a determined distance from and in front of each other, the distance between the cylinders being so selected that it corresponds to the distance between the openings 22 (Cf. FIG. 3) in the double bottom sections 21. Each section 21 is then lowered down to the intended position in relation to the cylinders 9, for example until the elements 17 (FIG. 2) rest against the cylinders, after which section 21 is welded to the cylinders at least along the edges 23 (FIG. 3) of the openings 22.

In the above description, it has been assumed that the width of the openings 22 essentially corresponds to the corresponding dimension of the associated cylinders 9. If the cylinders 9 are to project out of the double bottom 8 less than the distance illustrated in the drawings the width of the openings 22 may be reduced after the openings have been moved down over the cylinders to the intended position. For this purpose, the necessary seam elements (not shown here) can, be mounted in advance on the cylinders or set in place simultaneously as the double bottom sections are welded on.

As the cylinders 9 according to the above have essentially the same length as the mid section 4, all the double bottom sections 21 belonging to this section can be welded in a corresponding manner both onto the cylinders 9 and to each other. After this has been done, the deck and shell plating sections 34 which are included in the mid section 4, are assembled and fastened, as well as the fore and aft sections 38, 39 of the bow and stern sections 2, 3. However, the deck and shell plating sections 34 in front of a machinery space 40 and at other places where bulky equipment is to be conveyed to the inside of the hull are omitted until such equipment has been installed.

The order between the bow and stern sections and the deck and shell plating sections can vary depending on the size of the ship, the draught after completion of the double bottom of the mid-section, etc. This order is thus not considered to be an essential characteristic for the method according to the invention.

When the majority of sections 34, 38, 39 has been mounted and welded onto the hull, at least all the bulky equipment intended to be installed inboard is loaded. This applies to primary engines 36, auxiliary engines, boilers, etc. Only after this has been done is the incomplete hull 1 completed with the previously omitted sections which can belong to the mid-section as well as the bow and/or stern sections.

In addition to the above mentioned advantages of the hull according to the present invention, the hull design results in marked stability, which makes it possible to load large deck cargoes. The parallel sides of the hull also provide advantageous load space in the lowest deck.

It should be added that the bottom construction of the hull gives rise to increased buoyancy even when the hull is in a damaged state. A low tonnage coefficient can also be obtained for current measurement rules. Furthermore, the ship has a minimum draught.

What I claim is:

1. In a hull for marine vessels having a double bottom construction comprising an outer bottom, connecting parts between the outer bottom and the sides of the hull and an inner bottom which extends between the sides of the hull above the outer bottom:

a. at least two buoyant hollow cylinders arranged fore-and-aft in said hull and separated from one another in the athwartships direction;

b. said cylinders constituting an integrated part of the double bottom construction and having substantially the same length as the mid-section of the hull extending between the bow and stern sections of the hull;

c. said cylinders being situated substantially along their full length partly inside the double bottom construction and partly projecting through openings adapted to the cylinders, said openings being located in the double bottom shell plating;

d. the casings of the cylinders being connected to the edges of said openings in a watertight manner; and e. the casing portions and end pieces of the cylinders projecting outside said openings being watertight.

2. Hull according to claim 1, including a waterline area above the cylinders divisible into at least two simple geometrical surface elements, one of said surface elements being rectangular and substantially larger than the others, the remaining smaller surface elements each separately forming a tapering extension to the rectangle and being connected to one of its short sides or each also separately forming a tapering extension to a said smaller surface element on the side of the latter element which is facing away from the rectangle.

3. Hull according to claim 2, wherein the remaining smaller surface elements have the shape of a triangle or a trapezoid.

4. Hull according to claim 1, wherein all of the plates included in the hull are planar and cylinder casing-shaped.

5. Hull according to claim 1, wherein all of the plates included in the hull are planar, single-bent and cylinder casing-shaped.

6. Hull according to claim 4, wherein the cylinder casing-shaped plates are included at least in the casings of the cylinders.

7. Hull according to claim 6, wherein the cylinder casing-shaped plates are also included in the stem of the hull.

8. Hull according to claim 4, wherein the connecting parts between the sides of the hull and the outer bottom comprise inwardly and downwardly inclined planar or single-bent plates.

9. Hull according to claim 1, wherein the hull sides of the mid-section are substantially parallel.

10. Method of assembling a hull for a marine vessel, whereby at least partly finished components are joined together in sections, said sections as well as equipment parts being transported to and stored at a storage location situated next to an assembly location intended for the hull, said assembly location being formed by a protected water area, the sections then being brought from the storage location in predetermined sequence and taken to the assembly location so as to be joined together in intended mutual positions, comprising the steps of a. conveying to a protected water area a plurality of buoyant hollow cylinders having substantially the same length as the midsection of the hull extending between the bow and stern sections of the hull;

b. floating said cylinder at the same level in a predetermined spaced parallel relationship to each other;

c. lowering only the cylinders double bottom sections of the mid-section, said double bottom sections having openings turned downwardly and adapted to receive the cylinders;

d. joining the double bottom sections with the cylinders and with one another so as to form a buoyant double bottom construction having approximately the length of the mid-section of the hull;

e. placing deck and shell plating sections on the floating double bottom construction and joining them thereto and to one another while leaving a section open for loading of equipment;

f. arranging at least one bow section and one stern section with respect to the mid-section and joining the said sections;

g. loading required equipment inboard of the floating hull; and h. completing assembly of the hull by mounting the previously omitted deck and shell plating sections in their appropriate positions and joining them with one another and appropriate previously assembled sections.

11. Method according to claim 10, wherein the buoyant hollow cylinders are manufactured by the steps of floating a plurality of buoyant hollow cylinder sections on a protected water area, each cylinder section being floated in end-to-end postion with at least one adjacent cylinder section, one at a time, in such manner that the longitudinal axes of the respective cylinder sections are brought into alignment, and joining together the respective cylinder sections.

12. Method according to claim 11, including the steps of joining the adjacent cylinder sections by rotating them about their longitudinal axes while in floating position, and welding the abutting edges of the cylinder sections during said rotation, the rotation speed essentially corresponding to the welding speed.

* * * * *